US006499408B1

(12) United States Patent
Kundel, Sr.

(10) Patent No.: US 6,499,408 B1
(45) Date of Patent: Dec. 31, 2002

(54) RAIL SUPPORT ASSEMBLY FOR MONORAIL CRANE

(76) Inventor: Robert Kundel, Sr., 2186 Howland Wilson Rd., Cortland, OH (US) 44410

( * ) Notice: Subject to any disclaimer, the term of this patent is extended or adjusted under 35 U.S.C. 154(b) by 0 days.

(21) Appl. No.: 10/114,509

(22) Filed: Apr. 2, 2002

(51) Int. Cl.[7] ..... E01B 25/00

(52) U.S. Cl. ..... 104/94; 104/111; 105/155

(58) Field of Search ..... 104/89, 94, 95, 104/107, 111; 105/148, 155, 154; 16/87 R, 91, 94 R, 96; 248/58; 212/312, 314, 315

(56) References Cited

U.S. PATENT DOCUMENTS

| | | | | |
|---|---|---|---|---|
| 509,650 | A | | 11/1893 | Brodie |
| 1,422,473 | A | * | 7/1922 | Phillips ..... 104/111 |
| 3,855,937 | A | * | 12/1974 | Caudill ..... 104/94 |
| 3,974,777 | A | * | 8/1976 | Monne ..... 104/94 |
| 3,987,877 | A | * | 10/1976 | Bulanchuk ..... 191/23 A |
| 4,267,778 | A | | 5/1981 | Wilkie |
| 4,344,206 | A | | 8/1982 | Hermanson |
| 4,454,928 | A | | 6/1984 | Marneau et al. |
| 4,694,531 | A | | 9/1987 | Foy |
| 4,984,523 | A | | 1/1991 | Dehne et al. |
| 5,277,298 | A | | 1/1994 | McDonald et al. |
| D343,936 | S | | 2/1994 | McDonald et al. |
| D344,389 | S | | 2/1994 | McDonald et al. |
| 5,285,889 | A | | 2/1994 | McDonald |
| 5,361,890 | A | | 11/1994 | McDonald et al. |
| D370,759 | S | | 6/1996 | Kubsik et al. |
| D371,666 | S | | 7/1996 | Kubsik et al. |
| 5,598,785 | A | * | 2/1997 | Zaguroli, Jr. ..... 104/111 |
| D384,470 | S | | 9/1997 | Kubsik et al. |
| D384,471 | S | | 9/1997 | Kubsik et al. |
| 5,669,518 | A | * | 9/1997 | Kundel ..... 212/315 |
| 5,931,288 | A | | 8/1999 | Avery |
| 6,138,574 | A | | 10/2000 | Zaguroli, Jr. |

* cited by examiner

*Primary Examiner*—Mark T. Le
(74) *Attorney, Agent, or Firm*—Robert J. Herberger

(57) ABSTRACT

A rail support system pendent from an overhead structure is provided for supporting, lifting, and conveying material, machinery, and equipment from one location to another, and for supporting movable trolleys and traveling cranes. The rail support system includes a plurality of side rail members wherein the side rail members are disposed in opposed pairs in uniform parallel alignment thereby forming a runway section with one or more runway sections disposed in successive end-to-end relationship to form a runway track. The alignment of the opposed pairs of side rail members are maintained by spacers and clamps that are disposed between and interconnect the side rail member pairs. Trolley vehicles travel in v-shaped track guides of the side rail members, and adjacent side rail members forming each half of the runway sections are secured together by joint plates that prevent the separation of the adjacent side rail members.

19 Claims, 7 Drawing Sheets

RAIL SUPPORT ASSEMBLY FOR MONORAIL CRANE

FIELD OF INVENTION

This invention relates to monorail systems for use in manufacturing and industrial settings. More particularly, this invention pertains to a rail support assembly for suspension from an overhead structure or surface in order to form a monorail system for conveying and supporting machinery, material, and equipment, and for carrying a traveling crane for lifting and transporting machinery, material, and equipment.

BACKGROUND OF THE INVENTION

Overhead rail tracks are widely used in numerous commercial, industrial, and manufacturing settings. Overhead rail tracks, commonly referred to as monorail systems, have also been incorporated into many public transportation systems, and are used as efficient people movers in, for example, resort parks, amusement parks, zoos, and sports facilities and complexes.

Because the work areas and floors of workshops, manufacturing assembly lines, and industrial plants are often cluttered and crowded with machinery and workers, it is often difficult and awkward to move material and product from one location to another location. The use of gantries in steel mills and paper mills is one structure that is used to overcome this problem. The frames or towers of the gantry move in ground based rail tracks while carrying an overhead traveling crane. Gantries are useful for lifting and conveying heavy loads but their area of operation is fixed, and they are most appropriate for large-scale industrial settings. Movable arms or jibs are used in smaller workshops but their range of operation and adaptability is also limited.

Prior art devices that illustrate overhead monorail or conveyor-type systems include Wilkie (U.S. Pat. No. 4,267,778), Hermanson (U.S. Pat. No. 4,344,206), Marteau et al. (U.S. Pat. No. 4,454,928), Foy (U.S. Pat. No. 4,694,531), Dehne et al. (U.S. Pat. No. 4,984,523), McDonald et al. (U.S. Pat. No. 5,277,298), McDonald et al. (U.S. Pat. No. 5,285,889), McDonald (U.S. Pat. No. 5,361,890), Avery (U.S. Pat. No. 5,931,288) and Zaguroli Jr. (U.S. Pat. No. 6,138,574).

Nonetheless, there remains a need for a rail support system or assembly that is adaptable to various work sites and can be specifically customized for the area dimensions and work environment for which it is utilized.

SUMMARY OF THE INVENTION

The present invention comprehends monorail track systems, and, more particularly, comprehends a rail support assembly for suspension from an overhead structure in order to create a monorail track system for lifting, supporting, and conveying material and equipment, and for supporting thereon a traveling crane.

The present invention includes a plurality of side rail members with the side rail members suspended from the overhead structure in opposed pairs of uniform parallel spaced alignment. The pairs of side rail members are disposed in end-to-end relationship pendent from the overhead structure to form runway sections, and the runway sections cooperate to form the monorail track system. Each side rail member includes a major body portion, a lower track section, and an upper curvilinear end. The lower track section is v-shaped and defines an inner track guide.

A plurality of spacers engage the side rail members to interconnect the opposed pairs of side rail members and to maintain the uniform parallel alignment of the side rail members. Each spacer includes opposed upper rail engaging portions that conform to the upper curvilinear ends of the side rail members so that the upper rail engaging portions can be received within and fitted to the upper curvilinear ends thereby connecting the spacers to the side rail members. In addition, the rail support assembly also includes a plurality of clamps that cooperate with the spacers to interconnect the opposed pairs of side rail members so that the uniform spaced parallel alignment of the side rail members is maintained. Each clamp has opposed end portions shaped to conform to the upper curvilinear ends of the side rail members, and the end portions of the clamps are superposed on the curvilinear ends and in alignment with the upper rail engaging portions of the spacers so that the curvilinear ends of the side rail members are enclosed between and held by each pair of cooperating clamps and spacers.

In order to facilitate the movement and conveyance of machinery, material, and equipment throughout the work site, and to support a traveling crane, at least one—and preferably a plurality—of trolley vehicles are disposed within the side rail member pairs forming the runway sections for reciprocable movement therealong. Each trolley vehicle includes two pairs of opposed wheels, and the wheels ride within and along the inner track guides of the side rail members. The wheels are spring loaded or biased to enhance the unimpeded movement of the trolley vehicles along the inner track guides and within and between the opposed pairs of side rail members.

In order to suspend the rail support assembly from the overhead structure a plurality of u-shaped hangers are utilized. In suspending the rail support assembly one hanger is secured to an adjacent pair of spacers wherein each hanger extends upwardly from each respective spacer pair for attachment to any convenient fixture or element that is directly mounted on or into the overhead structure.

The rail support system also includes a plurality of joint plates that have a cross sectional configuration generally coinciding with the side rail members, and each joint plate is secured to two adjacent side rail members that are disposed in end to end relationship in order to prevent the separation of the adjacent side rail members and to provide a continuous extension of the side rail members for forming successive runway sections.

It is an objective of the present invention to provide a rail support assembly that is of relatively low cost and is easy to assemble and disassemble with a minimum of tools and expertise.

It is another objective of the present invention to provide a rail support assembly wherein the primary structural elements can be fitted and snapped together thus minimizing or eliminating the need for fasteners to be inserted into and through all the elements for interconnecting the elements.

It is yet another objective of the present invention to provide a rail support assembly having side rail members that can be assembled without the use of welds or lugs.

It is still another objective of the present invention to provide a rail support assembly that can support a traveling crane for lifting and conveying machinery, material, and equipment throughout the work site.

Still another objective of the present invention is to provide a rail support assembly wherein runway tracks formed by successive pairs of side rail members disposed in end to end relationship can be arranged in a number of levels or stacks from the overhead structure down so that each runway track extends transverse to the runway track located above and below that runway track.

Yet still another objective of the present invention is to provide a rail support assembly wherein a precision alignment of the structural elements is not a requirement for assembling the rail support assembly.

A further objective of the present invention is to provide a rail support assembly wherein the side rail members include lower track sections having v-shaped inner track guides that enhance the unimpeded movement of mechanical or electrical devices therealong.

A still further objective of the present invention is to provide a rail support assembly wherein trolley vehicles are disposed within the side rail members for reciprocable movement within and along the inner track guides of opposed pairs of side rail members.

A yet still further objective of the present invention is to provide a rail support assembly including joint plates for connecting adjacent side rail members that are disposed in end to end relationship with the joint plates preventing the separation of the adjacent side rail members so that a continuous traveling surface is provided for the trolley vehicles.

These and other objects, features and advantages of the present invention will become apparent to those skilled in the art upon a perusal of the entire disclosure herein along with the accompanying drawings.

Figure 1:
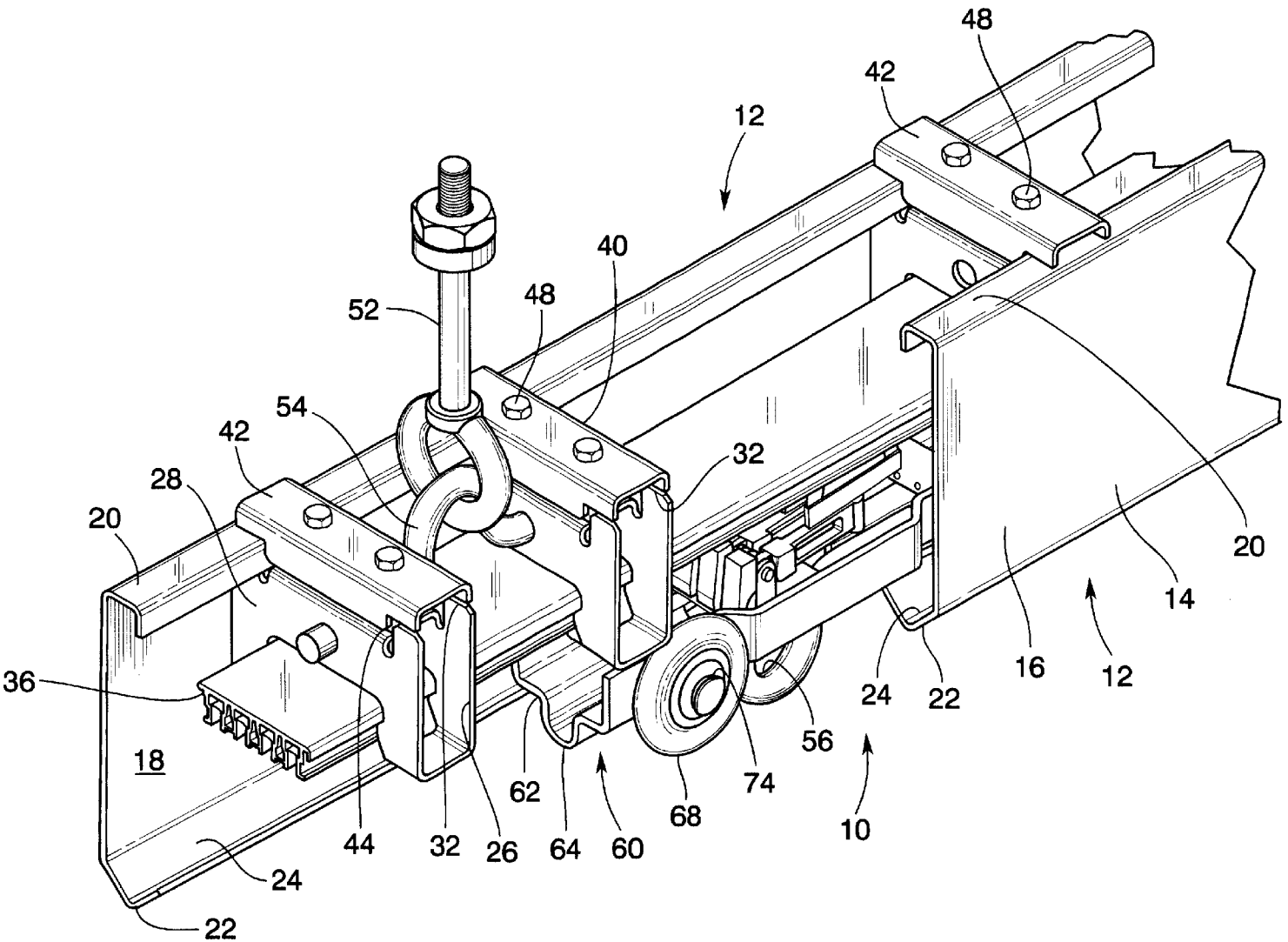
FIG. 1 is a perspective cut away view of the rail support assembly of the present invention illustrating side rail members interconnected by spacers and clamps and the disposition of a trolley vehicle therebetween.
Figure 2:
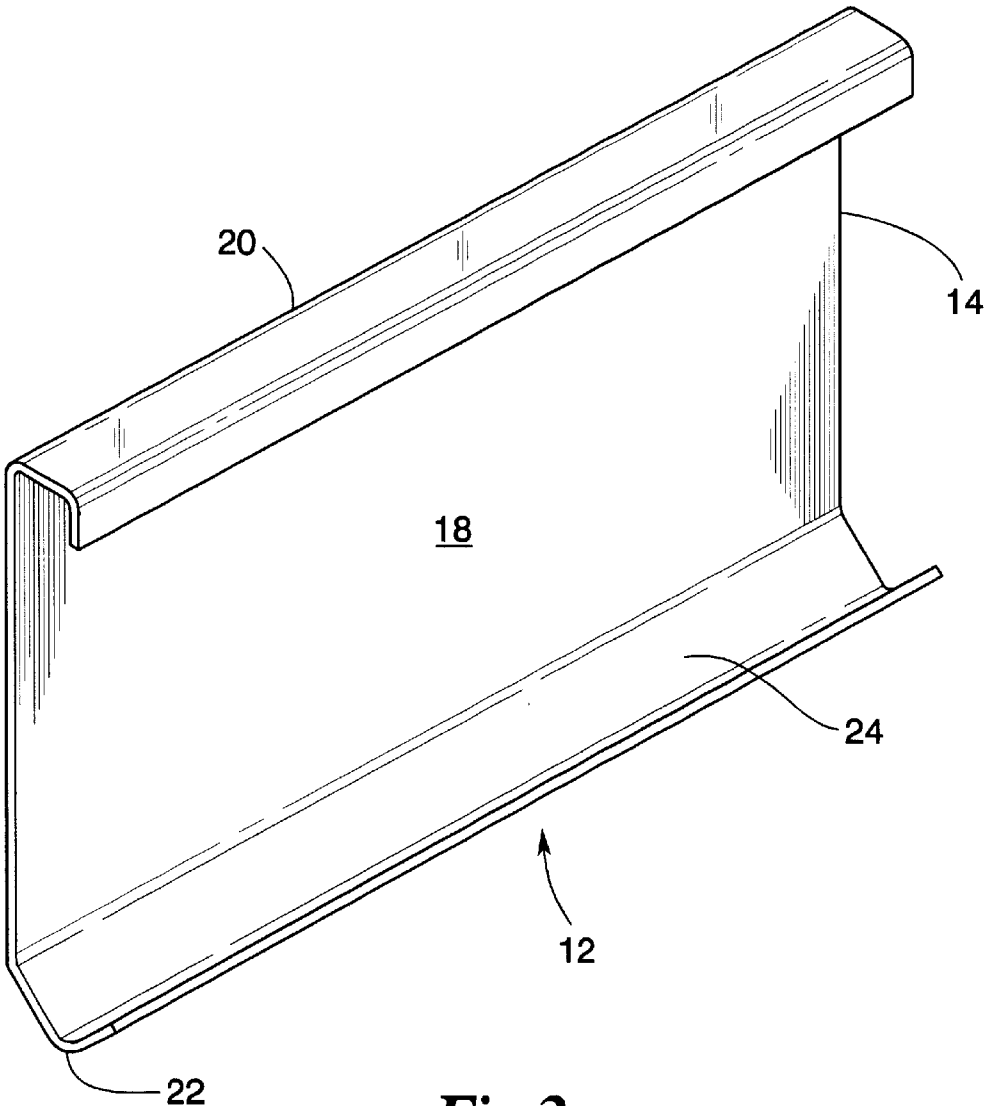
FIG. 2 is a perspective view of one side rail member that comprises one half of one runway section.

It is to be understood, however, that the drawings are designed for the purpose of illustration only and not as a definition of the limits of the instant invention, for which reference should be made to the claims appended hereto. Other features, objects and advantages of this invention will become clear from the following more detailed description made with reference to the drawings.

DETAILED DESCRIPTION OF THE PREFERRED EMBODIMENT

Illustrated in FIGS. 1–7 is a rail support system or assembly 10 for suspension from an overhead structure or surface, such as a joist, steel beam, arm, or ceiling, and which can support a traveling crane for lifting, conveying, and supporting a variety of machinery, equipment, and material. The rail support system 10 has wide applicability and can be utilized in many industrial settings such as, for example, steel mills, food processing plants, paper mills, automotive assembly plants, fabricating, molding, and machine shops. When fully deployed the rail support system 10 of the present invention forms a monorail track or tracks that are pendent from the overhead structure and horizontally extend in both longitudinal and transverse directions with respect to the overhead structure.

As shown in FIGS. 1–7 the rail support system 10 of the present invention includes a number of structural elements that are adaptable to the particularities of different work sites, and are relatively easy to assemble and disassemble using a minimum number of tools and expertise. Thus, shown in FIGS. 1, 2 and 5–7 are a plurality of elongated, rectangular-shaped (when viewed from a side elevation) half rail members or side rail members 12. In their operative disposition the side rail members 12 are disposed pendent from the overhead structure and in spaced-apart longitudinally extending relationship. The side rail members 12 are mounted from the overhead structure in oppositely disposed pairs to form a runway section for creating a portion of the monorail track system. Each side rail member 12 includes a generally flat major body portion 14 having an exterior side or surface 16 and an interior side or surface 18. Each side rail member 12 further includes an upper curvilinear end 20 and an opposite lower track portion 22 both of which are integrally formed from the major body portion 14. In cross section the side rail members 12 have a configuration roughly similar to a flattened, somewhat c-shaped channel or conduit. In addition, the lower track portion 22 of each side rail member 12 has a v-shaped configuration for defining an inner track guide 24 that is coequal in length thereto and extends adjacent to the interior side 18 of the major body portion 14. The inner track guide 24 provides what can be referred to as a grip bottom for elements hereinafter further described.

Figure 3:
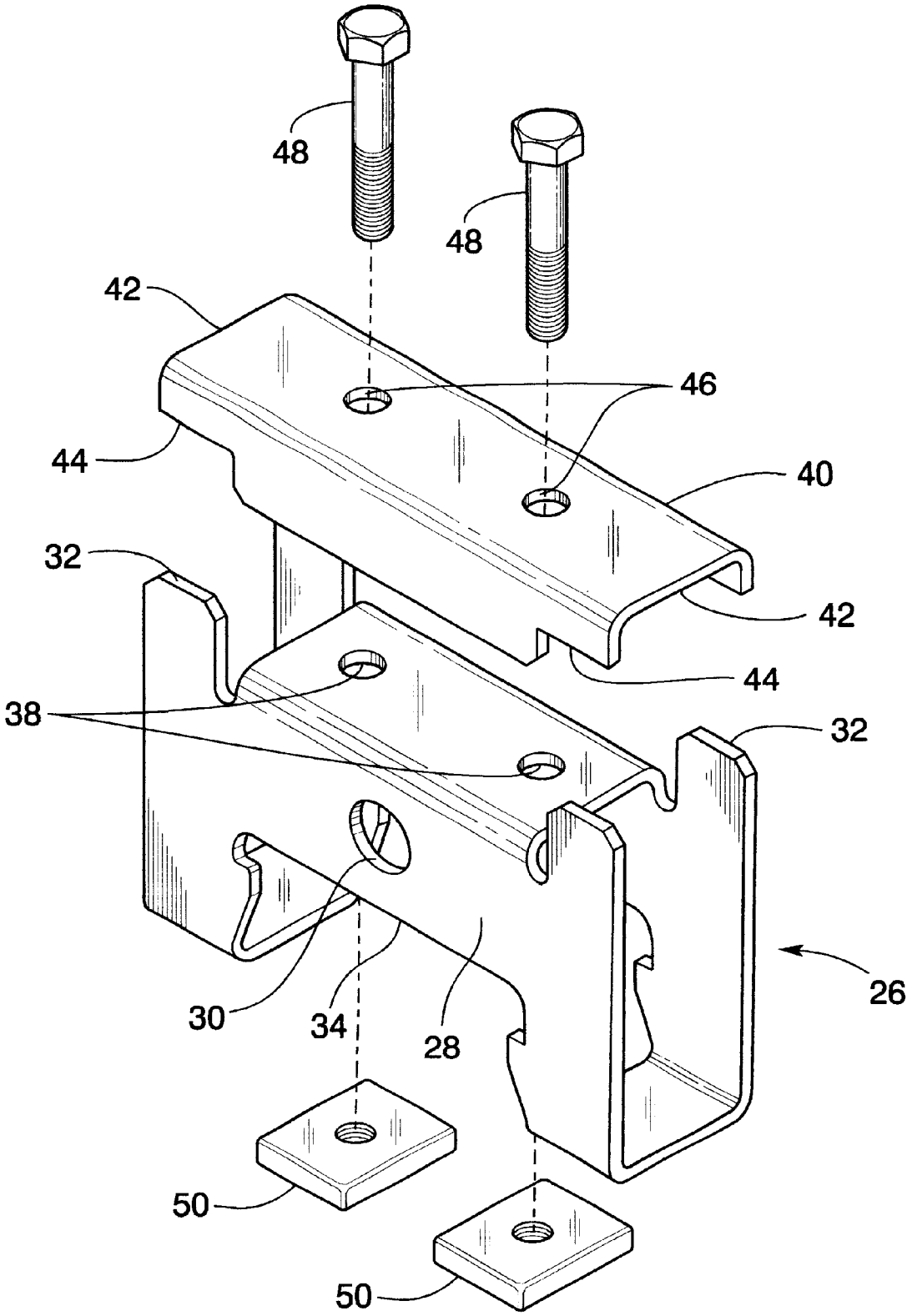
FIG. 3 is an exploded perspective view of one spacer and one clamp illustrating their attachment to each other.
Figure 4:
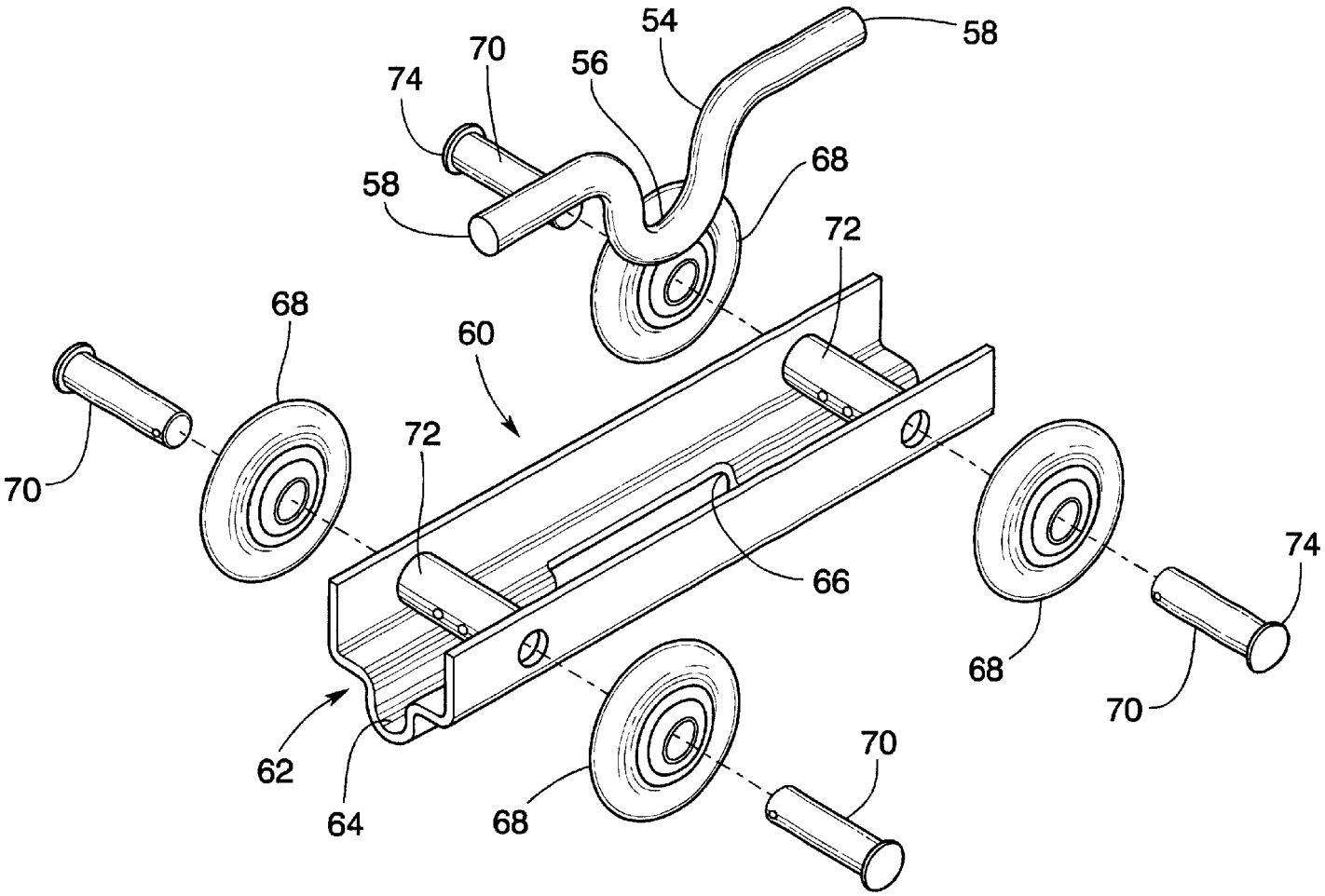
FIG. 4 is an exploded view of a trolley vehicle.

Illustrated in FIGS. 1, 3 and 4 is one of the structural elements that cooperate with the side rail members 12 in order to interconnect each pair of side rail members 12 and to maintain the spaced parallel alignment of the side rail members 12 with respect to each other when suspended from the overhead structure. Specifically, shown therein are a plurality of spacers 26 wherein one or more spacers 26 are disposed between, and connected to, each pair of opposed side rail members 12. The spacers 26 can be manufactured from sheet metal or molded plastic, for example, and have a somewhat squashed H-shaped configuration in front elevational view. As best seen in FIG. 3, each spacer 26 includes a central body portion 28 through which at least one centrally located hanger aperture 30 extends. Integrally formed from the central body portion 28, and extending upwardly therefrom, are at least one pair of opposed upper rail engaging portions 32. The upper rail engaging portions 32 are shaped so as to conformably engage and be received by the interior portion of each upper curvilinear end 20 of each side rail member 12. The upper rail engaging portions 32 of the spacers 26 fit within the interior portions of the upper curvilinear ends 20 of the side rail members 12 as seen in FIG. 1. Each spacer 26 also defines a lower or bottom inner portion 34 that is of an elongated channel shape in order to receive and hold securely therein electrical conduction elements such as electrical cables, conduit, or bars 36. Finally, each spacer 26 also includes at least two spacer apertures 38 that extend downwardly completely through the central body portion 28 of the spacer 26.

Figure 5:
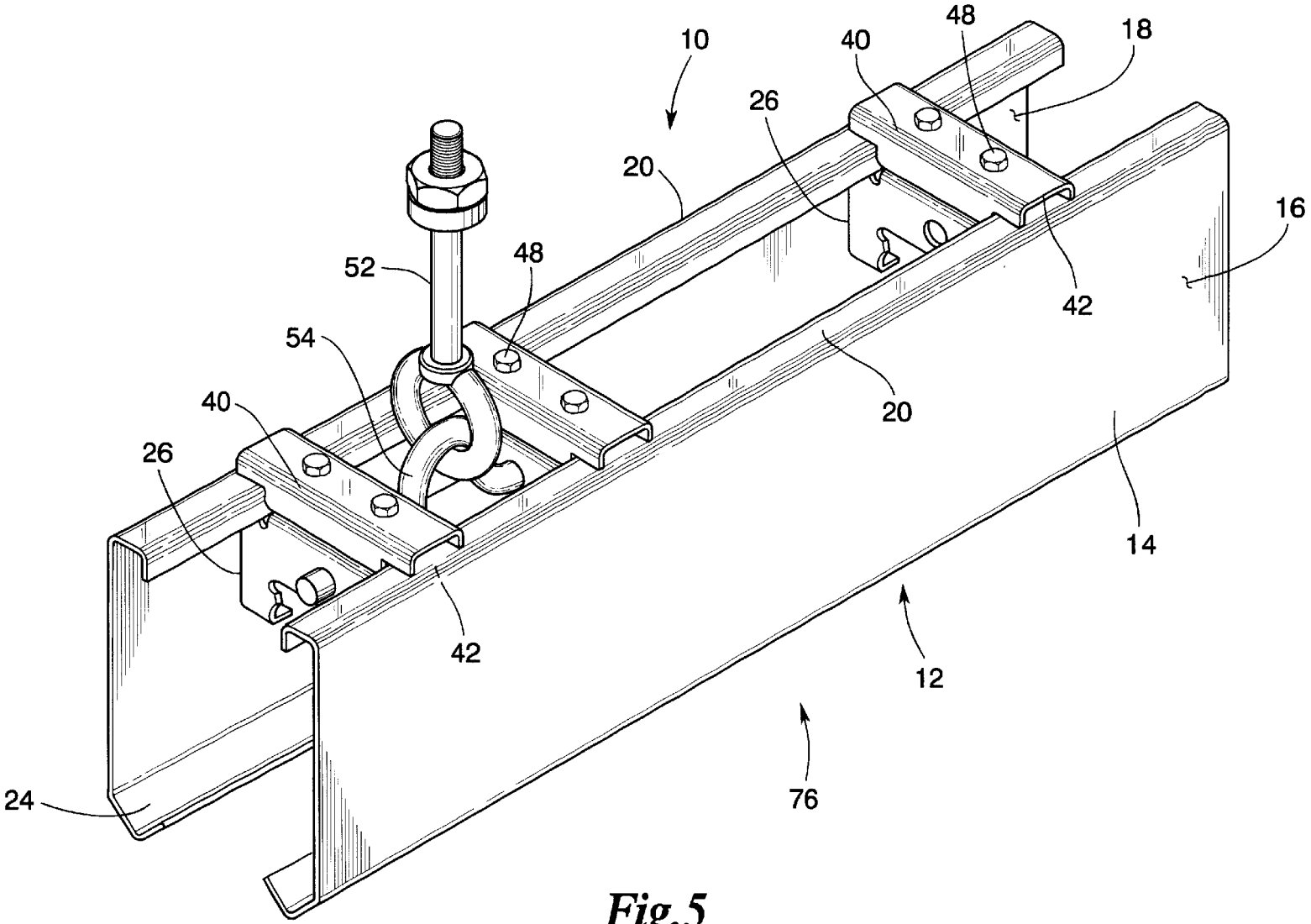
FIG. 5 is a perspective view of two side rail members interconnected by spacers and clamps to form one runway section.

Illustrated in FIGS. 1, 3 and 5 is another structural element that cooperates with the spacers 26 in order to secure and maintain the pairs of longitudinally extending side rail members 12 in their spaced parallel alignment. Shown therein are a plurality of clamps 40 that are generally elongated in shape and of a flattened u-shape as viewed in cross section. Each clamp 40 has opposed end portions 42 that further define a lower rectangular shaped cut out 44 that substantially conforms to the upper curvilinear ends 20 of the side rail members 12. Moreover, in assembling the clamps 40 to the spacers 26 for securing the side rail members 12 in position, one clamp 40 is used with one spacer 26 and is first positioned in vertical alignment with that spacer 26. The end portions 42 of the clamps 40 are then superposed on the respective curvilinear ends 20 of the opposed side rail member 12 pairs so that each rectangular-shaped cut out 44 contacts and engages the aforesaid curvilinear ends 20. In effect the curvilinear ends 20 of the side rail members 12 are enclosed between and held secure by the upper rail engaging portions 32 of the spacers 26 and the cut outs 44 of the clamps 40. Each clamp 40 has at least two clamp apertures 46 extending through the body of the clamp 40, and when the clamp 40 is brought into vertical alignment with the corresponding spacer 26, the clamp apertures 46 are aligned with the spacer apertures 38 so that fasteners 48, such as bolts or screws, can be passed there through for adjoining the clamp 40 to the spacer 26 so that nuts 50, such as the flat nuts of figure, can be tightened onto the fasteners 48. The cooperating interconnection of the clamps 40 with the spacers 26, and the enclosing of the upper curvilinear ends 20 of the opposed side rail member 12 pairs by the clamps 40 and spacers 26 maintains the uniform spaced parallel alignment of the side rail members 12 throughout their entire longitudinal extension pendent from the overhead structure. In effect, each opposed pair of side rail members 12 are snapped together by the use of the cooperating pairs of clamps 40 and spacers 26. Thus screws or bolts are not needed to mechanically secure the clamps 40 and spacers 26 directly into the side rail members 12 for fixing and holding the pairs of side rail members 12 in uniform spaced parallel alignment.

Various types of fixtures and devices can be used to suspend the pairs of side rail members 12 forming the runway sections from the overhead structure; and in the preferred embodiment of the invention rounded I-bolt hanging rods 52 are used to pendently mount the side rail members 12 from the overhead structure which could be, for example, a ceiling joist or an overhead steel framework. In order to connect the hanging rods 52 to the side rail members 12, a plurality of u-shaped hangers 54 are utilized, with one u-shaped hanger 54 used in conjunction with one hanging rod 52 as shown in FIGS. 1 and 5–7. Each u-shaped hanger 54 has a middle bight portion 56 and opposed hanger ends 58 with keepers [not shown] attached thereto. The hangers 54 can be iron bars forged into the appropriate shape.

Various steps and methods can be used to suspend the side rail members 12 from the overhead structure. One possible method of assembly is to first fix the hanging rods 52 into the overhead structure and then place one hanger 54 on each hanging rod 52. The assembled side rail members 12, interconnected and held in position by the pairs of joined clamps 40 and spacers 26, can then be lifted up so that adjacent pairs of spacers 26 and clamps 40, spaced slightly farther apart than the ends 58 of the hangers 54, are positioned so that the spacer apertures 38 of the adjacent spacers 26 are brought into alignment with the hangers 54. The adjacent pairs of spacers 26 can then be slid or maneuvered closer together so that the ends 58 of the hanger 54 are inserted into and project completely through the hanger apertures 38 thus fixedly suspending the side rail members 12 from the overhead structure. Other methods of mounting are contemplated such as assembling one or more runway sections and then lifting up the entire runway section for fixing the hanging rods 52 into the overhead structure. This method would require some leveling of the runway sections and a type of hanging rod 52 wherein the insertable end was capable of turning while the ring or loop end of the hanging rod 52 that holds the u-shaped hanger 54 remained stationary.

In order to support and convey machinery, materials, and equipment about the workshop or plant floor, an additional device is used in conjunction with the rail support assembly 10 of the present invention. Specifically, as shown in FIGS. 1 and 4–7, at least one—and preferably a plurality—of trolleys vehicles 60 are used in conjunction with the side rail members 12 to perform various work operations. The trolley vehicles 60 may be electronically actuated, and include an elongated trolley body 62 roughly v-shaped in cross section. Integrally formed from the trolley body 62 is a downwardly projecting concave-shaped channel portion 64 that is coequal in length with the trolley body 62. A slot 66 is formed and centrally located on the channel portion 64. Each trolley 60 includes two pairs of wheels 68 mounted to the trolley body 62 by independent axles 70. Since each trolley vehicle 60 is capable of reciprocable movement along the runway sections it is not useful to designate the pairs of wheels 68 as the front and rear. Each pair of axles 70 is maintained in position by bushings 72 that extend from one side of the trolley body 62 to the other side and thus form tubular structures for receiving and securing therein the axles 70. As shown in FIGS. 1 and 4–7, the bight portions 56 of the hangers 54 are capable of extending through the slots 66 on the channel portions 64 of the trolley vehicles 60 when the hangers 54 are mounted within the channel portions 64. Thus, for example, a movable crane, machinery, materials, or equipment can be attached to the trolley vehicles 60 by the hangers 54 for lifting, support, and conveyance about the work site or plant floor.

To enhance the efficient movement and operation of the trolley vehicles 60 on and within the side rail members 12, each wheel 68 is spring biased or loaded on the respective axle 70 by a compression spring 74 as shown in FIGS. 1 and 4. Since the trolley wheels 68 ride in and partially on the inner track guides 24 of the side rail members 12, spring loading the wheels 68 achieves a number of favorable results. Spring loading of the wheels 68 allows for some lateral movement of the trolley vehicles 60 between the side rail members 12 they are traveling on, and this assists in maintaining the wheels 68 within the inner track guides 24 if there are slight variations from the uniform parallel longitudinal spacing of the respective side rail members 12. Also, the spring loading of the wheels 68 in combination with the contact and gripping of the wheels 68 by the inner track guides 24 maintains the trolley vehicles 60 in a central disposition relative to the opposed side rail member 12 pairs. A further result of this combination is that frictional contact of the wheels 68 and the slightly protruding ends of the axles 70 against the inner track guides 24 or the interior surfaces 18 of the side rail members 12 is minimized or prevented. Moreover, the inner track guides 24 of the lower track portions 22 grip the wheels 68 of the trolley vehicles 60 as the trolley vehicles 60 are traveling thereon and thus dynamically cooperate with the wheels 68 to assist in minimizing and preventing any lateral divergence or spreading of opposed pairs of side rail members 12.

Figure 6:
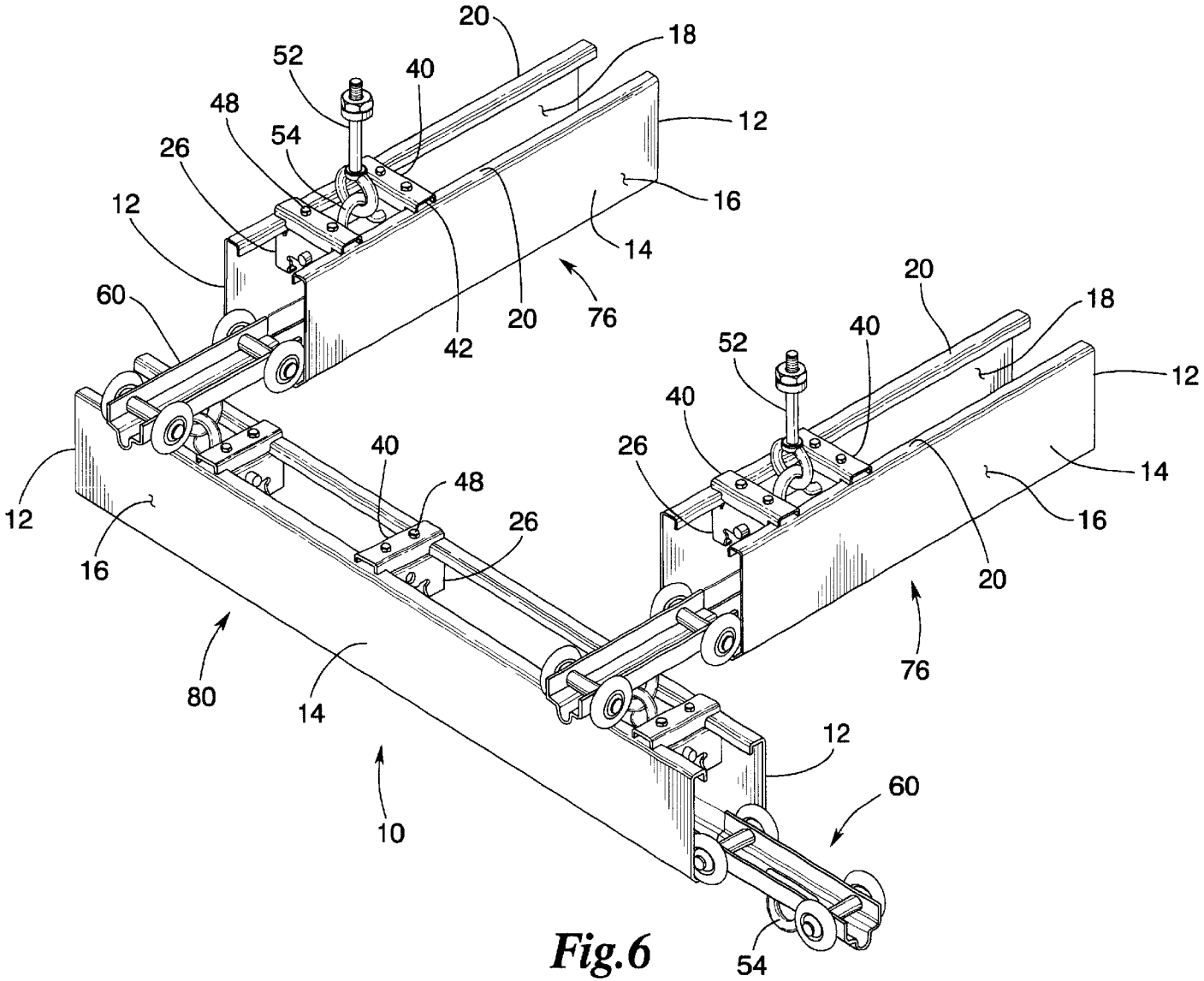
FIG. 6 is a perspective view of two runway sections to which a bridge section is suspended.
Figure 7:
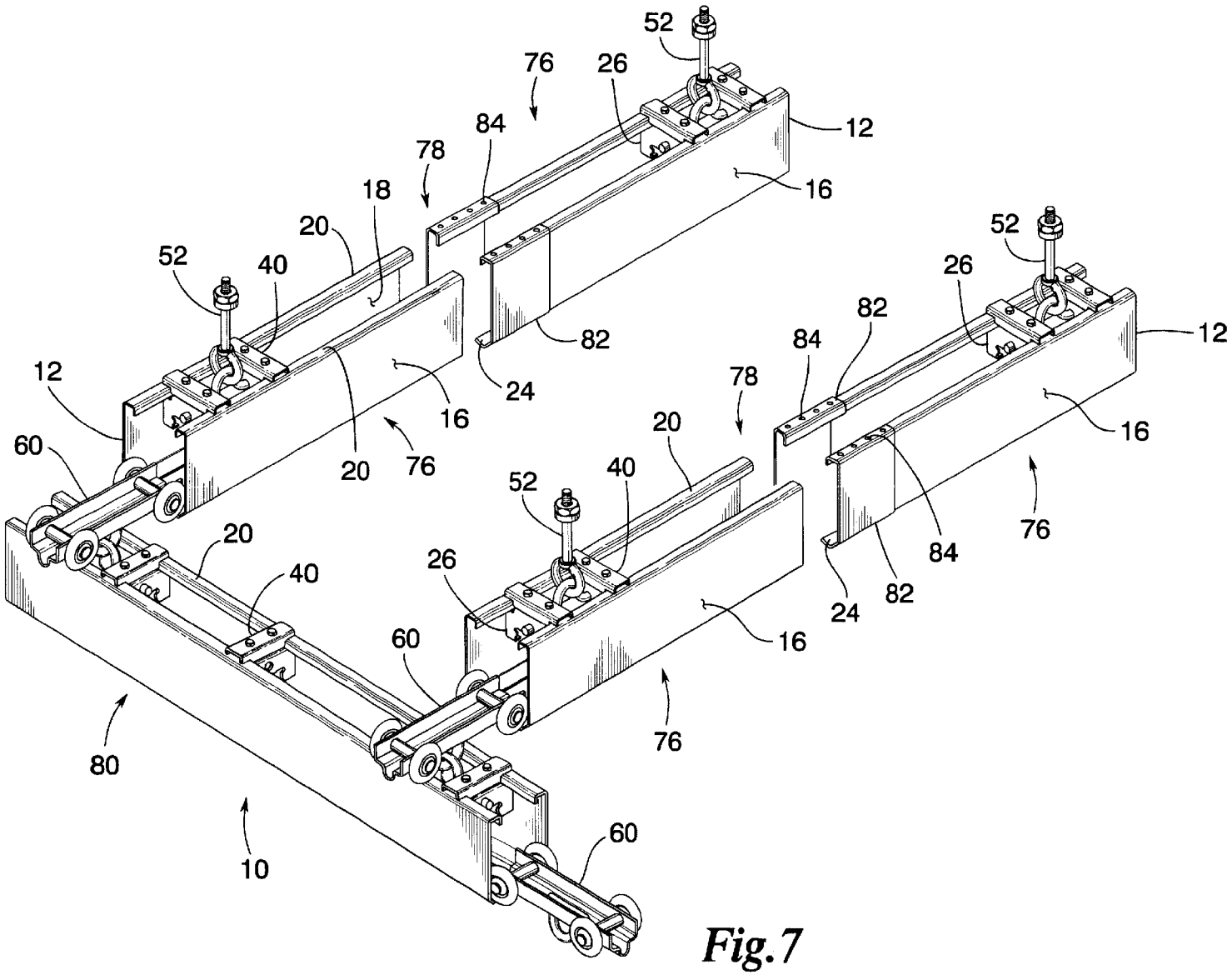
FIG. 7 is a perspective view of two longitudinally extending runway tracks from which a transverse bridge section is suspended.

As shown in FIGS. 5–7, opposed pairs of interconnected side rail members 12 can be successively disposed to form runway sections 76 for the trolley vehicles 60, and one or more runway sections 76 can be disposed in end to end relationship to each other to form one or more runway tracks for the monorail system. In addition, the rail support system 10 of the present invention has the capability and flexibility to stack runway sections 76 comprising and forming the runway tracks one from the other commencing with the initial assembly and securement of two spaced runway tracks to the overhead structure and then proceeding downward. The two runway tracks can be denoted for illustrative purposes as the longitudinally extending runway tracks 78, and would thus extend longitudinally beneath and pendent from the overhead structure and above the work shop or plant floor. At least one runway track, denoted for illustrative purposes the bridge track 80, could then be disposed pendent from and extend transverse to and below the longitudinal runway tracks 78 to which the bridge track 80, in turn, is suspended. While the bridge track 80, as shown in FIGS. 6 and 7, extends transverse to the longitudinal runway tracks 78, the movement of the bridge track 80 would coincide with the extension of the longitudinal runway tracks 78. The bridge track 80 would be carried or moved therealong by the trolley vehicles 60 running within the inner track guides 24 of the longitudinal runway tracks 78 and to which the bridge track 80 would be interconnected by the u-hangers 54. The traveling crane (not shown) would be carried by the bridge track 80 and movable therealong.

The length of the side rail members 12 can vary although generally side rail members 12 are six to twelve feet in length. This permits the user to create one or more overhead monorail tracks composed of successive runway sections 76 that are appropriate for the given room, shop, warehouse or plant. The rail support assembly 10 of the present invention permits side rail members 12 of different lengths to be placed in end-to-end abutting relationship to span the room and fit the particular dimensions. It is not necessary that all the pairs of side rail members 12 that are placed in end-to-end relationship to form successive runway sections 76 as part of a runway track be of equal length. The user can thus customize the rail support assembly 12 to the specific use.

As shown in FIG. 7, in order to achieve this flexibility, and also to maintain the end to end longitudinally abutting relationship of adjacent side rail members 12, a plurality of joint plates 82 are used with one joint plate 82 attachable to each pair of adjacent side rail members 12 that are brought together in end-to-end disposition. The joint plates 82 have a flattened channel-shaped cross sectional configuration that conforms to and fits over and encompasses the entire exterior surface of the side rail members 12 from the edge of the lower track portion 22 to the upper edge of the upper curvilinear ends 20. Each joint plate 82 includes several spaced apart joint plate apertures 84 through which fasteners, preferably set screws, are inserted for engaging and securing the joint plates 82 to the respective adjacent side rail members 12. The use of the joint plates 82 prevents the separation of the ends of two adjacent side rail members 12 disposed in end-to-end relationship and the joint plates 82 also provide a continuous surface for the trolley wheels 68 to travel on. Furthermore, since the fasteners do not physically extend into and through the side rail members 12 it is not required to align the joint plates 82 for opposed pairs of side rail members 12. Thus, each half of one runway section 76 can be assembled from side rail members 12 that may not all be equal in horizontal length to the side rail members 12 comprising the other half of the given runway section 76. As a result, non-use or waste of side rail members 12 because there are not a sufficient number of side rail member 12 pairs of equal length to form a given runway section 76 is avoided or eliminated.

The foregoing description discloses and describes a preferred embodiment of the invention, and those skilled in the art will understand that other variations and modifications may be possible and practicable, and may come within the ambit of the appended claims.

I claim:

1. A rail support assembly pendent from an overhead structure for supporting and transporting machinery and equipment, the rail support assembly comprising:

a plurality of runway sections disposed in end to end relationship from the overhead structure and each runway section including:

at least one pair of spaced-apart half rail members with each half rail member having a flat major body portion, a curvilinear upper end, and a lower track portion;

a plurality of spacers with each spacer disposed between the half rail members for maintaining a spaced parallel alignment for the half rail members, and each spacer having an upper spacer portion that conforms to the curvilinear upper end of each half rail member;

a plurality of clamps with each clamp being superposed on the upper curvilinear ends of each pair of half rail members and in vertical alignment with one respective spacer so that each clamp can be secured to each spacer in order to interconnect the half rail members and maintain the uniform spaced parallel alignment of the half rail members; and a plurality of u-hangers with each u-hanger attachable to one pair of adjacent spacers for suspending each runway section from the overhead structure.

2. The rail support assembly of claim 1 wherein the lower track portion of each half rail member is v-shaped and define an inner track guide.

3. The rail support assembly of claim 2 further comprising at least one trolley disposed within each runway section for reciprocable movement therein along the runway section.

4. The rail support assembly of claim 3 wherein each trolley includes two pairs of wheels and both pairs of wheels disposed within the lower v-shaped track portion and in contact with the inner track guides of the half rail members.

5. The rail support assembly of claim 4 wherein each pair of wheels are mounted to the trolley by an axle and each wheel is spring biased on the respective axle to permit lateral floating of the wheels on the axles in order to compensate for variations in the spaced parallel alignment of the half rail members and to minimize frictional contact of the wheels against the inner surface of the major body portion of the half rail members.

6. The rail support assembly of claim 5 further comprising at least one u-hanger that can be mounted to each trolley so that the u-hanger extends downwardly from the trolley.

7. The rail support assembly of claim 6 wherein a plurality of runway sections can be pendently mounted from the overhead structure in order to form a runway track.

8. The rail support assembly of claim 7 wherein the u-hangers that downwardly extend from the trolleys movable within one runway track can support subjacent runway sections that extend transverse to the above extending runway sections from which they are supported.

9. A runway section for suspension from an overhead structure for supporting and conveying machinery and equipment, comprising:

a pair of opposed side rail members with each side rail member including a flat major body portion, a upper curvilinear end, and a lower track portion;

a plurality of spacers with each spacer disposed between and interconnected to the side rail members in order to facilitate the uniform spaced parallel alignment of the side rail members to each other;

a plurality of side rail clamps with each side rail clamp superposed on the upper curvilinear ends of the side rail members and in alignment with each respective spacer for securement to the spacer in order to maintain the uniform spaced parallel alignment of the side rail members; and a plurality of u-hangers with each u-hanger capable of being attached to two adjacent spacers and projecting upwardly therefrom so that each u-hanger can be attached to the overhead structure for pendently supporting the runway section therefrom.

10. The runway section of claim 9 wherein the lower track portion of each side rail member is v-shaped and define an inner track guide.

11. The runway section of claim 10 wherein a plurality of runway sections can be placed in end-to-end relationship to form a horizontally extending runway track that is pendent from the overhead structure.

12. The runway section of claim 11 wherein each spacer includes opposed upper rail engaging portions and each upper rail engaging portion has a configuration that conformably attaches to the upper curvilinear ends of the side rail members.

13. The runway section of claim 12 wherein the upper curvilinear ends of the opposed pairs of side rail members are enclosed between and secured to the upper rail engaging portions of the spacers and the corresponding clamps in order to maintain the uniform parallel alignment of the side rail members.

14. A monorail assembly for attachment to an overhead structure for supporting and conveying machinery and equipment, comprising:

a plurality of side rail members with pairs of side rail members disposed pendent from the overhead structure in an opposed longitudinally extending relationship to each other;

each side rail member including a flat major body portion, an upper curvilinear end, and a lower v-shaped track portion;

a plurality of spacers with each spacer interconnected to the upper curvilinear ends of opposed side rail members for maintaining a uniform parallel alignment of the side rail members throughout their longitudinal extension;

a plurality of clamps with each clamp superposed on the upper curvilinear ends of the side rail members and in vertical alignment with the corresponding spacer for attachment to the spacer in order to maintain the uniform parallel alignment of the side rail members with respect to each other;

a plurality of rail hangers with each rail hanger attachable to at least one pair of adjacent spacers in order to suspendingly support the side rail members from the overhead structure;

each pair of opposed pairs of side rail members capable of being suspended from the overhead structure in end to end horizontal extension with other pairs of opposed side rail members in order to form a monorail runway track; and a plurality of joint plates with each joint plate having a cross sectional configuration coinciding with the cross sectional configuration of the side rail members and the joint plates being removably securable at the ends of adjacent side rail members that are disposed in end to end relationship.

15. The monorail assembly of claim 14 wherein the upper curvilinear ends of the side rail members are engaged by and enclosed between the upper rail engaging portions of the spacers and the clamps for maintaining each pair of opposed side rail members in their uniform parallel alignment.

16. The monorail assembly of claim 15 wherein the lower track portions of the side rail members define an inner track guide.

17. The monorail assembly of claim 16 further comprising at least one trolley vehicle for disposition within each opposed pair of side rail members and movable therein to facilitate the supporting and conveyance of machinery and equipment.

18. The monorail assembly of claim 17 wherein the wheels of the trolley vehicle ride within the inner track guides of the opposed side rail members for maintaining the central disposition of the trolley vehicle with respect to the side rail members.

19. The monorail assembly of claim 18 wherein the wheels of the trolley vehicle are spring biased to permit independent lateral floating of the wheels on their respective axles in order to compensate for any non-uniformity in the spacing of the pairs of side rail members and to minimize frictional contact of the wheels against the side rail members.

* * * * *